US005086846A

United States Patent [19]

Carlson

[11] Patent Number: 5,086,846

[45] Date of Patent: Feb. 11, 1992

[54] FOAM-DISPENSING APPARATUS

[76] Inventor: Richard F. Carlson, 357 Palos Verdes Dr. West, Palos Verdes Estate, Calif.

[21] Appl. No.: 518,026

[22] Filed: May 2, 1990

Related U.S. Application Data

[63] Continuation-in-part of Ser. No. 442,617, Nov. 29, 1989.

[51] Int. Cl.[5] ..... A62C 3/00; A62C 35/58

[52] U.S. Cl. ..... 169/15; 169/14; 169/44; 169/85

[58] Field of Search ..... 169/14, 15, 44, 85, 169/62

[56] References Cited

U.S. PATENT DOCUMENTS

| | | | |
|---|---|---|---|
| 2,043,599 | 6/1936 | Waldshmidt | 169/15 |
| 2,707,480 | 5/1955 | Klosse | 169/15 |
| 2,860,856 | 11/1958 | Baker | 169/14 |
| 3,001,377 | 9/1961 | Diquattro | 169/15 |
| 3,142,340 | 7/1964 | Jamison | 169/15 |
| 3,342,271 | 9/1967 | Anthony, Jr. | 169/15 |
| 3,750,754 | 8/1973 | Stults | 169/15 |
| 3,923,288 | 12/1975 | King | 239/432 |
| 3,977,474 | 8/1976 | Boegli | 169/09 |
| 4,208,136 | 6/1980 | King | 138/37 |

FOREIGN PATENT DOCUMENTS

| | | | |
|---|---|---|---|
| 100266 | 5/1962 | Nauru | 169/14 |
| 89349 | 10/1958 | Netherlands | 169/14 |

*Primary Examiner*—Joseph F. Peters, Jr.
*Assistant Examiner*—Virna Lissi Mojica
*Attorney, Agent, or Firm*—Malcolm B. Wittenberg

[57] ABSTRACT

Apparatus for dispensing a surfactant for use in extinguishing fires, particularly wildfires, which provides two separate means for storing the surfactant and the water needed to expand the surfactant into a high grade of foam to be extinguished over the wildfire. The apparatus also incorporates a stationary mixing device for mixing and re-mixing the water and surfactant to the extent required to produce the high quality of foam needed to extinguish wildfires. An emergency valve release is incorporated such that the entire apparatus of the invention will become operative with a single release of this valve by the operator of the equipment incorporating the inventive apparatus. The inventive apparatus can be advantageously installed on heavy equipment used in fighting wildfires.

10 Claims, 3 Drawing Sheets

FIG._1
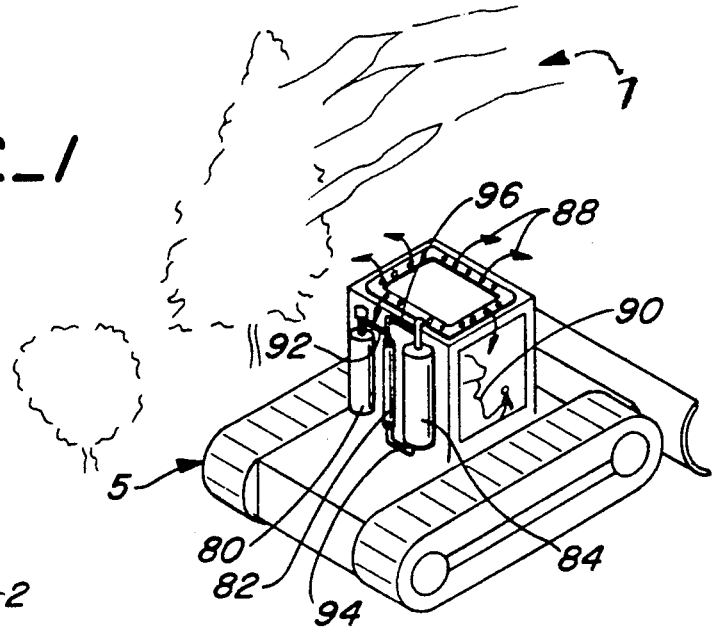
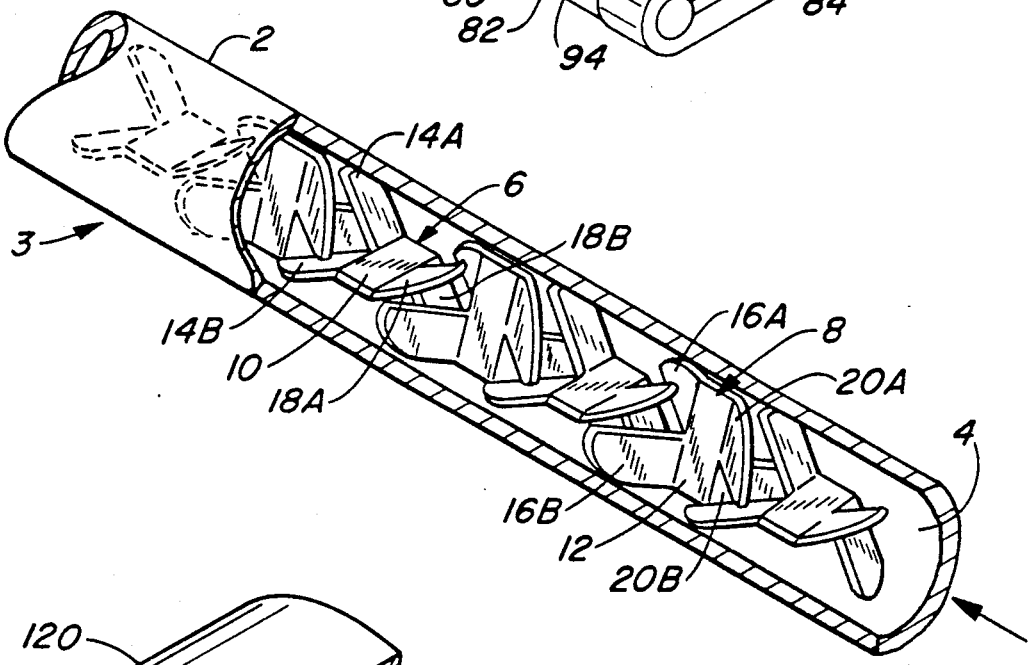
FIG._3
(PRIOR ART)
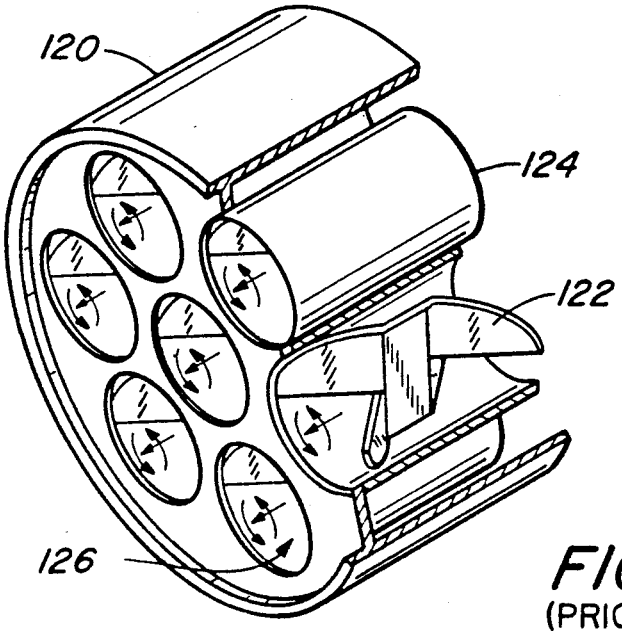
FIG._5
(PRIOR ART)

FOAM-DISPENSING APPARATUS

This is a continuation-in-part application of U.S. application Ser. No. 442,617 filed Nov. 29, 1989.

BACKGROUND OF THE INVENTION

This invention relates generally to an apparatus for dispensing a surfactant, such as foam, over an area and, in particular, it relates to a new and improved apparatus for dispensing foam to extinguish fires. The apparatus is particularly suitable for installation on heavy mobile equipment, such as tractors, bulldozers and other similar equipment used in fighting fires, particularly forest fires.

It has been determined that in fighting wildfires, such as forest fires or even chemical fires in a more confined area, foam is about eighty-six percent (86%) more effective than water alone. That is, water is about eight percent (8%) effective in fire fighting while foam is about ninety-four percent (94%) effective in extinguishing wildfires. While water is still needed to extinguish fires even where foam is the dominant element being used, it has been determined that the amount of water needed is reduced by approximately seventy-five percent (75%) when used in combination with foam than where the water is used alone. The combination of foam and water expands the volume or the capacity of the foam by approximately seven (7) to ten (10) times the normal volume of a foam used alone.

Despite the remarkable advantage of foam in fighting wildfires, there is a problem which exists in the prior art devices used to dispense the foam and the problem usually occurs after the foam and water have been mixed. Thus, once the foam and water have been combined, which is a necessary step when foam is used, there is still a problem of getting the high quality of foam, i.e., bubbles, needed for dispensation over a desired area which would be effective in fighting wildfires. The problem is magnified when the water and foam mixture is allowed to sit as a combination for a period after the two elements have been mixed and are unused for a period of time, during which the foam starts to substantially lose its forming ability or ability to make bubbles which are needed to extinguish the fires. This problem can result even where the foam and water mixture is allowed to sit for minutes, not hours. Thus, even though the water is needed to facilitate the foaming activities of the foam surfactant, the combination or mixture of the foam and water, if allowed to stand for a period of time results in a foam being dispensed which is not much more effective than water alone to fight wildfires.

The above-described problem becomes even more acute when human life is at stake such as the life of the firefighter who is operating the heavy equipment for dispensing the foam or other surfactant. With very large wildfires advancing with a velocity of between 35–45 miles per hour for a period of two (2) to three (3) minutes, it is imperative that the person operating the equipment for dispensing the substance for fighting the fire, is at least himself protected from the swift oncoming flames. The problem described above is one which is to applicant's knowledge well known in the art and is prevalent in most, if not all existing, surfactant dispensing apparatuses and is one to which a solution is urgently needed. It is therefore desirable to have an apparatus which is capable of dispensing a high quality of usable foam for a period of 3–4 minutes over a desired area to combat the flames which are rapidly advancing at a very high velocity, to not only extinguish the wildfire but, more importantly, to protect the life of the firefighter. Such an apparatus does not exist today.

The prior art apparatuses are either unable to respond in the time period required (0–3 minutes) or are unable to dispense the quality of foam or other surfactant needed or both.

SUMMARY OF THE INVENTION

In view of the grave problems which still exists with the prior art devices used in dispensing surfactants over areas where wildfires are engaging, applicant has addressed the problem in a most novel manner. Accordingly, applicant has developed a surfactant dispensing apparatus which provides two separate storage means for storing the surfactant (foam) and the water needed for expanding the surfactant into a very high quality of foam usable for fighting wildfires. Applicant's apparatus further has a means for releasing the surfactant into the water supply when needed and a further means for mixing the surfactant and water combination in such a manner as to produce a very high grade of foam which is most effective in extinguishing wildfires.

Applicant's apparatus is suitably designed for installation on a tractor, bulldozer or other heavy equipment used in fighting wildfires; however, the apparatus may be equally useful in fighting fires in a stationary environment as in a chemical plant. By providing a means for separately storing a supply of surfactant and water, applicant has eliminated the problem which is so common in the prior art devices which occurs when the water and surfactant mixture is allowed to sit for a period of time prior to the time when it is needed to extinguish fires. Applicant has further incorporated a prior art stationary mixing device, having no moving elements, to further mix the water and surfactant together to yield a very high grade of bubbles or foam to be dispensed over the desired area.

The apparatus of the invention is equally useful with class A surfactants (normally used in fighting wild forest fires) and class AFFF surfactants (normally used in extinguishing chemical fires). Perhaps the greatest advantage of applicant's invention is that of saving the life of the firefighter who is operating the equipment for dispensing the substance to extinguish the fire.

Further advantages and characteristic features of the invention will become apparent to those of ordinary skill in the art upon a consideration of the drawings and the description of the preferred embodiments of the invention.

BRIEF DESCRIPTION OF THE DRAWINGS

FIG. 1 illustrates one embodiment of the apparatus of the invention;

FIG. 3 is a partially cut-away perspective view of a stationary mixing device of the prior art which is incorporated in one embodiment of the present inventive apparatus;

FIG. 5 is a partially schematic view of another stationary mixing device of the prior art which is incorporated in the embodiment of the invention illustrated in FIG. 4.

DESCRIPTION OF THE PREFERRED EMBODIMENTS

Figure 2:
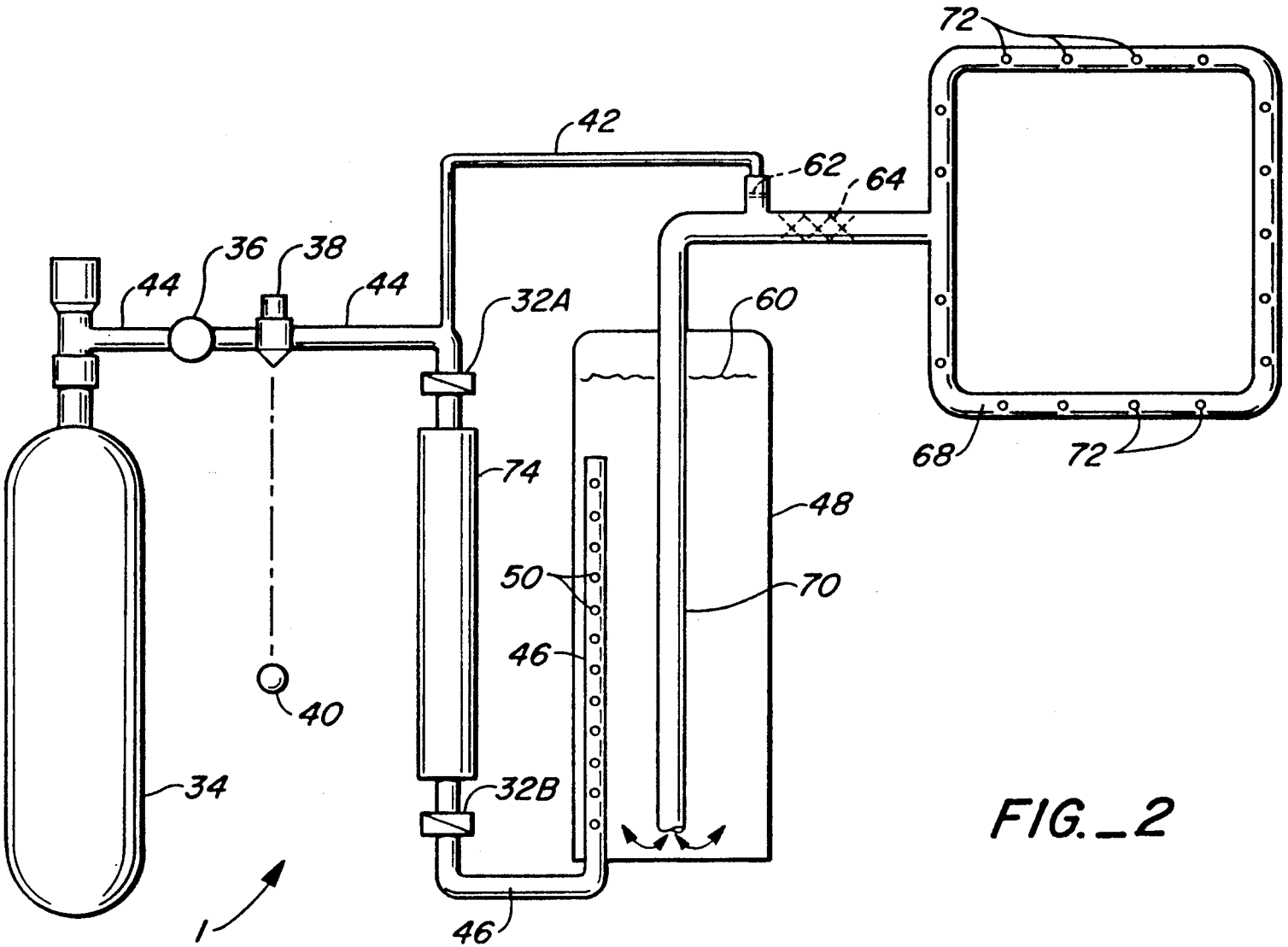
FIG. 2 is a partially schematic illustration of the apparatus according to the invention.

Perhaps the present invention will be best understood by referring initially to FIG. 2 where the apparatus of the invention is shown generally by reference numeral 1. A separate surfactant (foam) storage container 30 is connected by conduit 44 to a supply of compressed air in tank 34. The compressed air in tank 34 is maintained at a pressure of approximately 3,000 psi. Further disposed along conduit 44 is a pressure regulator 36 and a normally closed valve 38 which is controlled by an emergency valve release 40. Once emergency valve release 40 is pulled by the operator of the apparatus, valve 38 is opened and a stream of pressurized air is released from tank 34 along conduit 44 where pressure regulator 36 immediately causes the air pressure to drop to approximately 120–140 psi. The pressurized air now moves along conduit 44 in the direction of burst diaphragm 32A and conduit 42. Both of burst diaphragms 32A and 32B are set to be released in their open positions by air pressure of approximately 100 psi. Thus, with pressurized air of approximately 120–140 psi. flowing through conduit 44 toward diaphragms 32A and 32B, both diaphragms will open in response to the force exerted by the air pressure.

Now with both burst diaphragms 32A and 32B (set to be released by air pressure of approximately 100 psi) now opened, the surfactant 74 in container 30 will flow from container 30 pass burst diagram 32B and into conduit 46 where the surfactant will be dispensed through orifices 50 of conduit 46 and into the water supply 60 of container 48. While in container 48, surfactant 74 will mix with water 60 and will continue to flow upstream of water tank 48 through conduit 70 in the direction of a stationary mixing device 64 (See discussion of FIG. 3 below).

Simultaneously as pressurized air from tank 34 flows pass regulator 36 along conduit 44 to force burst diaphragms 32A and later 32B opened, pressurized air (now at approximately 120–140 psi) will flow along conduit 42 in the direction of stationary mixing device 64 which is located upstream of conduit 42 and water supply 48. As the pressurized air passes through conduit 42 in the direction of mixer 64, a metering device 62 has been inserted downstream of mixing device 64 to meter and control the flow of air from conduit 42 to mixing device 64. Once the air through conduit 42 is metered through metering device 62, the pressurized flow of air will further force the mixture of water and surfactant flowing along conduit 70 upstream towards and through mixing device 64 where the water and surfactant are further mixed and re-mixed by mixing device 64 in such a manner that substantial foaming of the mixture takes place and a very high quality of bubbles is produced from the water and surfactant mixture which has been shown to be approximately 94% effective in extinguishing wildfires.

Once the foam which now consists of a very high quality of bubbles passes through mixing device 64, it then flows to and through a dispensing element 68 which has a plurality of orifices 72 about its circumference to allow the foam to be immediately dispensed over a desired area.

Metering device 62 has been installed to assure a proper flow of air to mix with the surfactant and water mixture to produce the high quality of bubbles needed since without the proper infusion of air into this water and surfactant mixture, the desired quality of foam will not be produced. It has been determined that approximately one to one and one-half half (1 to 1 ½) standard cubic feet to air is needed per gallon of water and surfactant mixture to yield the quality of foam which has been found to be approximately 94% effective in fighting wildfires.

An air tank having a capacity of approximately 15 gallons of compressed air has been found to be suitable for one embodiment of the invention. With such a capacity, the apparatus of the invention is capable of producing a very high quality of foam to be dispensed over a period of approximately 3–4 minutes. Since wildfires, such as forest fires, will advance rapidly for approximately 2–3 minutes, an apparatus having the capacity to produce a high quality of foam for 2–3 minutes will have many practical advantages. With the apparatus of the invention installed on a tractor or bulldozer (see FIG. 1), an operator will be able to quickly release emergency valve 40 in the event that his equipment becomes consumed by fire and will be able to release an amount and quality of foam over his vehicle and for a period of time which will substantially, if not completely, extinguish the fire which may well result in saving the life of the vehicle operator.

Turning now to FIG. 3 which illustrates a prior art stationary mixing device of the type disclosed and claimed by applicant's assignee in U.S. Pat. No. 3,923,288. Specifically, mixing device 3 has a conduit 2 with an internal chamber 4 in which a plurality of left and right-handed elements 6 and 8 are fitted along a longitudinal axis which passes through chamber 4.

Elements 6 and 8 are mirror images of each other and each respectively has a flat central portion 10 and 12; a first pair of ears 14A, 14B and 16A, 16B; and second pair of ears 18A, 18B and 20A, 20B. Elements 6 and 8 are nested together such that the first pair of ears of one element overlaps with the second pair of ears of the next element as elements 6 and 8 are distributed in chamber 4 along the longitudinal axis of conduit 2. The configuration of elements 6 and 8 individually and with respect to each other and the alternating distribution of these elements along conduit 2 results in mutually opposed angular and radial vectors which in turn result in mutual shearing effects which cause the water and surfactant mixture flowing through device 3 (device 64 of FIG. 2) to mix and re-mix in different configurations as the surfactant and water mixture flows through conduit 2 past elements 6 and 8.

As was pointed out during the discussion of FIG. 2, the metered air through metering device 62 assists the flow of the water and surfactant mixture through mixing device 64 and further enables the mixture passing by elements 6 and 8 to mix and re-mix along conduit 2 until substantial foaming has resulted in the mixture and a very high quality of foam is produced for distribution through orifices 72 of dispensing element 68 of FIG. 2.

FIG. 1 illustrates one embodiment of applicant's invention which shows the apparatus described in connection with FIG. 2 installed on a bulldozer 5. Bulldozer 5 is shown in the midst of a forest fire 7. The apparatus which is specifically described in the discussion of FIG. 2 is illustrated generally in FIG. 1 with a tank of compressed air 80 which is operatively connected to a surfactant container 82 via conduit 92. Tank 80 is further connected to a mixing device (not illustrated but as described in connection with FIG. 1 and illustrated with reference numeral 64 in FIG. 2) via conduit 96. Surfactant container 82 is connected via conduit 94 to a separate container of water 84.

Operator 90 has access while inside the bulldozer 5 to an emergency valve release (reference numeral 40 of FIG. 2) and when needed, this valve is released by operator 90 and the inventive apparatus which is installed on bulldozer 5 will function in the same manner as described in connection with FIG. 2. That is, once the valve has been released by operator 90, pressurized air from tank 80 will flow pass a regulator where the pressure of the air is reduced to approximately 120–140 psi. This pressurized air will then flow through conduit 92 where the pressurized air will force a burst diaphragm to open causing the surfactant to flow from container 82 pass another burst diaphragm which opens in response to the pressure exerted by the air and the moving surfactant and into conduit 94. The surfactant will then flow through conduit 94 into the water supply 84 where the surfactant is mixed with the supply of water. Further, the water and foam mixture will flow from container 84 through a mixing element such as that described in connection with FIGS. 1 and 2 where a very high quality of foam is produced for dispensation through orifices 88 which are disposed about the dispensing element 86. Once the foam is immediately released about orifices 88 of element 86, a fire which has consumed bulldozer 5 will be immediately extinguished within approximately 3–4 minutes. Such quick reaction will undoubtedly result in saving the life of operator 90!

Figure 4:
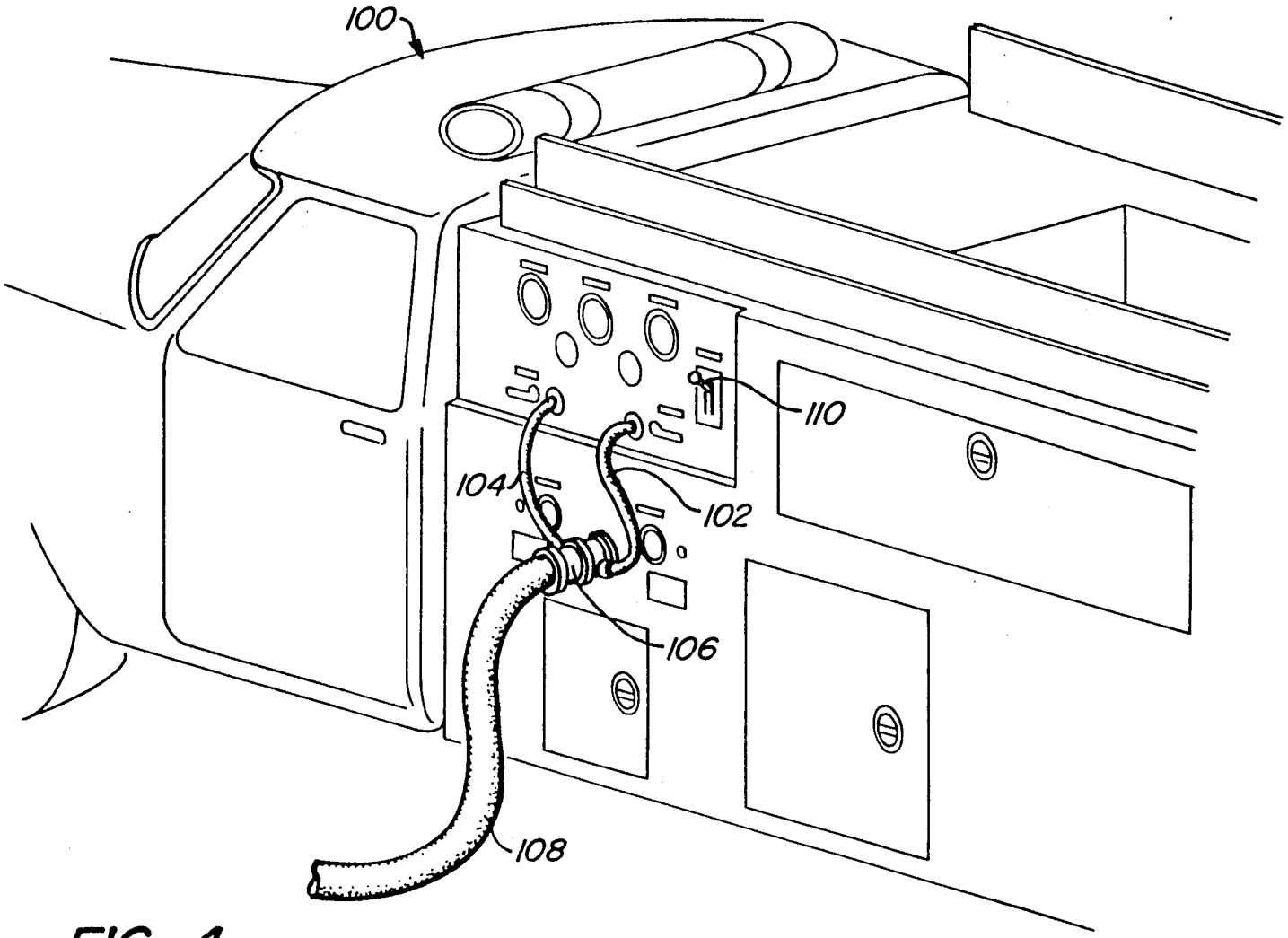
FIG. 4 illustrates a more compact embodiment of the invention being installed on a fire truck.

Still a further embodiment of the invention is shown in FIG. 4. Here, a compact version of the invention as primarily described in connection with the discussion of FIG. 2 is shown installed on fire truck 100. Hose 104 is connected to a tank of compressed air (see tank 34 of FIG. 2) which in this compact embodiment may be driven by a 10–25 hp motor (preferably gas or diesel) and which may be of a lesser capacity than tank 34 in FIG. 2. Hose 102 is connected to a surfactant container (see container 30 of FIG. 2) and operates in much the same way as does container 30. A manual control 110 is incorporated which allows for the operator to select and control the amount of surfactant to be added to the water supply (see tank 48 of FIG. 2). Control 110 may allow movement to vary from 1 to 10 or more levels to control the amount of foam to be generated and distributed over a desired area.

Once the device of FIG. 4 has been energized in much the same manner as described in connection with FIGS. 1 and 2 and compressed air has forced surfactant into the water supply, the water-surfactant mixture is forced in the direction of a mixing device as was described in connection with FIG. 2. However, here the mixing device, while it makes use of similar mixing elements, is of a different overall configuration. The mixing device used in the FIG. 4 embodiment of the invention is of the type disclosed and claimed by applicant's assignee in U.S. Pat. No. 4,208,136 and is described in connection with FIG. 5 below. Once the water-surfactant mixture flows in the direction of mixing device 106, control 110 is set at a desired level depending on the amount of foam required over a desired area. The water-surfactant mixture then flows through mixing device 106 where a foam having a very high quality of bubbles results and is dispersed through hose 108 over a desired area.

The mixing device of FIG. 5 has a number of individual elements 122 having a similar construction as elements 6 or 8 of FIG. 3; however, all elements are oriented in the same direction as illustrated by arrow 126 and are not each oriented in alternate directions as in FIG. 3. A plurality of elements 122 are each disposed within a sleeve 124 and are then disposed about the inner periphery of a conduit 120 having a length and a longitudinal axis passing through the length. The configuration of mixing elements 122 is ideal for assuring adequate mixing of the water and surfactant to form a high quality of foam, particularly in the compact embodiment where the mixture is unable to travel the distance of mixing device 3 of FIG. 3.

The inventive apparatus has been described with reference to certain specific embodiments; however, it is to be noted that various modifications and variations of the disclosed embodiments are anticipated as being within the spirit of the invention and it is believed that these variations and modifications will be apparent to those of ordinary skill in the art. The invention is thus intended only to be limited by the appended claims.

I claim:

1. A new and improved surfactant dispensing apparatus, comprising:

means for storing a supply of surfactant;

separate means, connected to said surfactant storage means, for storing, a supply of water such that said surfactant flows into said water supply when it is necessary to dispense surfactant from said apparatus;

a stationary mixing device disposed downstream of said water supply;

a metered supply of pressurized air having valve means for operatively connecting said air supply to said surfactant storage means and further to said mixing device by means of a first air conduit such that when said valve is in the open position pressurized air from said air supply forces surfactant from said foam storage means and into said water supply where said surfactant and water combine and are further forced by said pressurized air downstream towards and through said mixing device where said water and surfactant are further mixed by said mixing device in such a manner that substantial foaming results from the surfactant and water mixture as a substantial amount of bubbles are produced from said mixture thereby producing a high quality of surfactant to be dispensed over a desired area.

2. The apparatus of claim 1 wherein said air supply is further operatively connected to said mixing device by said valve means and a second air conduit such that when said valve is in the open position pressurized air from said air supply flows through said second air conduit to said mixing device where said pressurized air flow forces said water and surfactant mixture through said mixing device simultaneously as said air flow through said first air conduit is forcing said surfactant into said water supply and said water and surfactant mixture towards said mixing device.

3. The apparatus of claim 1 or 2 wherein said valve means connecting said air supply to said surfactant storage means and to said first and second air conduits are normally closed.

4. The apparatus of claim 2 wherein said air flow from said second air conduit is metered to said mixing device.

5. The apparatus of claim 4 wherein said air flow from said second air conduit is automatically metered to said mixing device.

6. The apparatus of claim 1 wherein said stationary mixing device is of the type which includes a conduit having a length, a longitudinal axis through said length, and a chamber extending longitudinally through said length opening on first and second ends of said conduit and including said longitudinal axis, a plurality of abutting, self-nested elements fitted within said chamber, adjacent elements being configured as mirror images of one another, each element having lengths along the longitudinal axis where adjacent elements axially overlap defining mixing matrices inducing both counter-rotating angular velocities relative to said longitudinal axis and simultaneous inward and outward radial velocities relative to said longitudinal axis on said surfactant and water mixture moving through said mixing matrices, each element having a length along the longitudinal axis where said elements do not axially overlap, the axially non-overlapping lengths of said elements along the length of the longitudinal axis defining drift spaces for the recombination of said surfactant and water mixture subsequent to movement through the mixing matrices, and wherein each of said elements comprises a flat rectangular central portion having first and second sets of ears adjacent opposite sides of said central portion, said sets of ears including first and second ears bent upward and downward relative to the plane of said central portion, said flat central portion lying along said axially non-overlapping length, and said sets of ears lying along said axially overlapping lengths.

7. The apparatus of claim 1 wherein said surfactant storage means is connected to said water supply by means of an elongated tube having a longitudinal surface and further having a plurality of orifices disposed along said longitudinal surface such that the surfactant being dispersed into said water supply is dispersed with a force along various points of said water supply.

8. The apparatus of claim 1 wherein said stationary mixing device is of the type which comprises a conduit having a length, a longitudinal axis through said length opening on first and second ends of said conduit and including said longitudinal axis, a plurality of mixing assemblies, each having at least one mixing element disposed within a sleeve portion, said assemblies disposed about the inner periphery of a length of said conduit with each mixing element of each of said assemblies oriented in the same direction as the elements within the adjacent assemblies about said conduit length and with at least one of said elements of one of said assemblies oriented in the same direction as the other of said elements of said assemblies and with said one assembly disposed about the center region formed by the other of said plurality of assemblies disposed about the periphery of said chamber.

9. The apparatus of claim 4 or 8 wherein said air flow from said second air conduit is manually metered to said mixing device such that the operator of said apparatus may control the amount of surfactant which is dispersed over a given area.

10. A new and improved surfactant dispensing apparatus, comprising:

means for storing a supply of surfactant;

separate means, connected to said surfactant storage means, for storing, a supply of water such that said surfactant may flow into said water supply when it is desired to dispense surfactant from said apparatus;

a stationary mixing device disposed downstream of said water supply;

a supply of pressurized air having valve means for operatively connecting said air supply to said surfactant storage means and further to said mixing device by means of a first air conduit such that when said valve is in the open position pressurized air from said air supply forces surfactant from said foam storage means and into said water supply where said surfactant and water combine and are further forced by said pressurized air downstream towards and through said mixing device where said water and surfactant are further mixed by said mixing device in such a manner that substantial foaming results from the surfactant and water mixture as a substantial amount of bubbles are produced from said mixture thereby producing a high quality of surfactant to be dispensed over a desired area, wherein said surfactant storage means further has a fore and an aft end with a first and second burst diaphragm disposed respectively at each of said fore and aft ends, said burst diaphragm being further operatively connected to said valve means such that when said valve means is in the open position, said burst diaphragms are also in the open position to allow pressurized air from said air supply to flow through said first burst diaphragm causing said surfactant to flow out of said surfactant storage means past said second burst diaphragm and into said water supply.

* * * * *